US006439880B1

(12) United States Patent
Ray

(10) Patent No.: US 6,439,880 B1
(45) Date of Patent: Aug. 27, 2002

(54) CLEAR CANDLE CONSTRUCTION

(76) Inventor: Robert Ray, 2371 Linden Dr., Woodstock, IL (US) 60098

( * ) Notice: Subject to any disclaimer, the term of this patent is extended or adjusted under 35 U.S.C. 154(b) by 0 days.

(21) Appl. No.: 09/503,604

(22) Filed: Feb. 11, 2000

(51) Int. Cl.[7] ..... C11C 5/00
(52) U.S. Cl. ..... 431/288; 44/275
(58) Field of Search ..... 431/288, 289, 431/291; 44/275

(56) References Cited

U.S. PATENT DOCUMENTS

| | | | | | |
|---|---|---|---|---|---|
| 21,706 | A | * | 10/1858 | Tatum | 431/288 |
| 1,462,601 | A | * | 7/1923 | Hohmann | 431/288 |
| 1,726,304 | A | * | 8/1929 | Lewis | 431/288 |
| 1,968,269 | A | * | 7/1934 | Swenson | 431/288 |
| 2,058,584 | A | * | 10/1936 | Gastel | 431/288 |
| 2,315,751 | A | * | 4/1943 | Webber | 431/288 |
| 3,091,952 | A | * | 6/1963 | Black | 431/288 |
| 3,428,409 | A | * | 2/1969 | Summers | 431/289 |
| 3,586,473 | A | * | 6/1971 | Galloway et al. | 431/288 |
| 3,615,289 | A | | 10/1971 | Felton | |
| 3,645,705 | A | | 2/1972 | Miller et al. | |
| 3,797,990 | A | | 3/1974 | Rogers et al. | 431/291 |
| 3,819,342 | A | | 6/1974 | Gunderman et al. | |
| 3,844,706 | A | * | 10/1974 | Tsaras | 431/288 |
| 4,115,370 | A | | 9/1978 | Corrado | |
| 4,332,548 | A | | 6/1982 | Linton et al. | 431/289 |
| 4,346,024 | A | | 8/1982 | Coquard et al. | |
| 4,449,987 | A | | 5/1984 | Lindauer | |
| 4,507,077 | A | * | 3/1985 | Sapper | 431/288 |
| 4,552,693 | A | | 11/1985 | Hussain et al. | |
| 4,568,270 | A | * | 2/1986 | Marcus et al. | 431/288 |
| 5,578,089 | A | | 11/1996 | Elsamaloty | 44/275 |
| 5,783,657 | A | | 7/1998 | Pavlin et al. | 528/310 |
| 6,111,055 | A | | 8/2000 | Berger et al. | 528/310 |
| 6,242,509 | B1 | | 6/2001 | Berger et al. | 523/122 |

FOREIGN PATENT DOCUMENTS

| | | | |
|---|---|---|---|
| JP | 59062699 A | * | 5/1984 |
| WO | WO 98/17243 | | 4/1998 |

OTHER PUBLICATIONS

Abstract titled Group VIII Transition Metal Catalysts for the Polymerization of Norbornene: New Catalysts, New Polymers and New Applications.Publisher unknown. Published at least as early as Feb. 1, 1999.
Brochure titled Topas® Cyclic Olefin Copolymers Product Information, 1997.
US 2002/0013444 A1, Jan. 31, 2002, Jones et al., 528, 170.

* cited by examiner

*Primary Examiner*—Sara Clarke
(74) *Attorney, Agent, or Firm*—Dick & Harris

(57) ABSTRACT

A candle construction incorporating a fuel core and a surrounding film having sufficient rigidity and/or stiffness along a vertical direction, to provide support for a fuel core which may be fabricated from a soft, cold-flowing or otherwise non-self-supporting material. The film is preferably fabricated from material(s) that are transparent or translucent, to permit visual inspection of the fuel core, and through the fuel core, if the fuel core is itself transparent or translucent. The film has a softening temperature range, the high end of which is greater than the high end of the melting temperature range of the fuel core material. When the fuel core material is molten and consumed through combustion, the film briefly remains in place to establish a vertical gap to contain the molten fuel material pool. The film may have one or more layers, with different materials and characteristics in the different layers.

61 Claims, 12 Drawing Sheets

Typical Properties of Topas® Grades

| | | | Topas® Cyclic Olefin Copolymers | | | | |
|---|---|---|---|---|---|---|---|
| | | | Basic Grades | | | Special Grades | |
| **Physical Properties** | **Unit** | **Test Method** | 8007 | 6013 | 6015 | 5013 | 6017 |
| Density | $g/cm^3$ | ISO 1183 | 1.02 | 1.02 | 1.02 | 1.02 | 1.02 |
| Water Absorption, immersion @ 23°C | % | ISO 62 | <0.01 | <0.01 | <0.01 | <0.01 | <0.01 |
| Water Permeability@23 C, 85% RH | $g-mm/m^2-d$ | DIN 53 122 | 0.023 | 0.035 | 0.035 | 0.030 | 0.045 |
| **Mechanical Properties @23°C, 50% RH** | | | | | | | |
| Tensile Strength | psi | ISO 527 Part 1&2 | 9600 | 9600 | 9600 | 9600 | 9600 |
| Elongation @ Break | % | Test Speed 50 mm/min | 10 | 4 | 4 | 3 | 4 |
| Tensile Modulus | psi | | 377,000 | 464,000 | 464,000 | 450,000 | 464,000 |
| Flexural Modulus | psi | ASTM D-790 | | | 500,000 | | |
| Charpy Impact Strength | $kJ/m^2$ | | 20 | 15 | 15 | 13 | 15 |
| Charpy Notched Impact Strength | $kJ/m^2$ | | 2.6 | 1.7 | 2.0 | 1.7 | 2.0 |
| Notched Izod Impact Strength | ft-lb/in | ASTM D-256 | | | 0.5 | 0.4 | |
| Rockwell Hardness, "R" Scale | – | | 113 | | 126 | 119 | 127 |
| Ball Indentation Hardness | | | 130 | 184 | 184 | 184 | 190 |
| **Thermal Properties** | | | | | | | |
| Heat Deflection Temperature @ 66 psi | °C | ISO 75 Part 1&2 | 75 | 130 | 150 | 130 | 170 |
| Thermal Conductivity | W/m- K | – | 0.16 | 0.13 | | 0.13 | |
| Coefficient of Linear Thermal Expansion | $K^{-1}$ | DIN 53752 | $0.7x10^{-4}$ | $0.610^{-4}$ | $0.6x10^{-4}$ | $0.6x10^{-4}$ | $0.6x10^{-4}$ |
| **Electrical Properties** | | | | | | | |
| Dielectric Constant @1-10 kHz | – | IEC 250 | 2.35 | 2.35 | 2.35 | 2.35 | 2.35 |
| Comparative Tracting Index | – | DIN IEC 112 | >600 | >600 | >600 | >600 | >600 |
| Specific Resistivity | Ohm-cm | DIN IEC 93 | $>10^{10}$ | $>10^{10}$ | $>10^{10}$ | $>10^{10}$ | $>10^{10}$ |
| **Flammability Rating** | | | | | | | |
| | Class | UL-94 | HB @1/16" | HB @1/16" | HB @1/16" | HB @1/16" | HB @1/16" |
| **Optical Properties** | | | | | | | |
| Light Transmission | % | ASTM D1003 | 92 | 92 | 92 | 93 | 92 |
| Refractive Index | – | – | – | – | – | 1.53 | – |
| Abbe Number | – | – | – | – | – | 58 | – |
| **Processing** | | | | | | | |
| Melt Flow Index @HDT + 115°C | ml/10 min | ISO 1133 | 4.5 | 16 | 16 | 71 | 12 |
| Glass Transition Temperature °C | – | – | 85 | 140 | 160 | 135 | 180 |
| Processing Temperature Range F | | | I:410-500 E: 390-465 | I:445-570 E:425-480 | I:445-570 | I:445-570 | I:445-570 |
| Molding Pressure Range, $10^3$ psi | – | – | 7 to 16 | 7 to 16 | 7 to 16 | 7 to 16 | 7 to 16 |
| Compression Ratio | | | 2.-3. | 2.-3. | 2.-3. | 2.-3. | 2.-3. |
| Mold Shrinkage @2mm thick, 60°C | % | – | 0.6-0.7 | 0.6-0.7 | 0.6-0.7 | 0.6-0.7 | 0.6-0.7 |

Note: I= Injection Molding, E= Extrusion

FIG. 11

Property Comparison: Topas® vs. Competitive Materials

| Property | Topas® COC | Polystyrene | Polycarbonate | Acrylic |
|---|---|---|---|---|
| Density (gm/cc) | 1.02 | 1.05 | 1.2 | 1.2 |
| Flex Modulus (Mpsi) | 0.5 | 0.45–0.5 | 0.34 | 0.45 |
| Tensile Strength (psi) | 9600 | 6400–8200 | 9000 | 10000 |
| Elongation (%) | 3–4 | 2–3.6 | 80 | 5 |
| Notched Izod (ft-lb/in) | 0.4 | 0.4 | 5–16 | 0.3 |
| HDT @66 psi (°C) | 75–170 | 76–94 | 142 | 92 |
| Hardness (Shore D) | 89 | 75–84 | 85 | 100 |
| Mold Shrinkage (%) | 0.6–0.7 | 0.4–0.7 | 0.5–0.7 | 0.2–0.8 |
| Water Absorption (%) | <0.01 | 0.1–0.3 | 0.3 | 0.1–0.4 |
| Advantages | • High stiffness<br>• Can have high HDT<br>• Low water absorption<br>• Relatively hard<br>• Low Density | • Low Cost | • Excellent impact-toughness<br>• High HDT | • High Stiffness<br>• Hardness<br>• Chemical resistance<br>• Weather resistant<br>• Low cost |
| Disadvantages | • Brittle | • Low HDT<br>• Relatively soft<br>• Brittle<br>• Heat resistance | | • High water absorption<br>• Brittle<br>• Heat resistance |

FIG. 12

Properties of Topas® Film vs. Selected Competitive Materials

| Property | Unit | Topas® | PET | PP | PC | PS | PVC | Aclar® |
|---|---|---|---|---|---|---|---|---|
| Specific Gravity | | 1.02 | 1.38–1.40 | 0.89–0.91 | 1.20–1.24 | 1.05 | | 2.08–2.12 |
| Water Absorption | % | 0.01 | 0.3–0.4 | <0.05 | 0.2–0.3 | 0.03–0.1 | 0.03 | <0.01 |
| Water Permeability | g–mm/$m^2$–d | 0.03** | 0.63 | 0.2 | 0.78 | 3.35 | 0.78 | 0.006–0.011 |
| Oxygen Permeability | cc–mm/$m^2$–d | 71 | 3 | 59 | 108 | 98–1640 | 7.8 | 2.8–5.9 |
| $CO_2$ Permeability | cc–mm/$m^2$–d | 60 | 15 | 280 | 430 | 350 | | 6–16 |
| Tensile Modulus | 10 Kg/$cm^2$ | 32 | 40 | 24–40 | 20 | 10–20 | 15 | 10–16 |
| Tensile Strength | 10 Kg/$cm^2$ | 9 | 15–25 | 16 | 10 | 6–10 | | 2–8 |
| Elongation @Break | % | 30 | 60–150 | 60–160 | 140–150 | 10–20 | | 115–300 |
| Melting Point | °C | – | 260 | 165 | – | – | | 190–211 |
| Softening Point | °C | 80–140 | 150 | 95–105 | 130–150 | 95–100 | | |
| Use Temperature | | 70–120 | <125 | <85 | <120 | <80 | | |
| Dielectric Constant, 60Hz | | 2.35 | 3.0–3.3 | 2.1–2.3 | 2.6–3.2 | 2.3–2.7 | | 2.56–2.72 |
| Dielectric Loss, 60Hz | % | <0.02 | 0.2–0.5 | <0.02 | 0.1–0.3 | 0.03–0.04 | | |
| Volume Resistivity | ohm–cm | $>10^{16}$ | $>10^{16}$ | $>10^{16}$ | $>10^{16}$ | $>10^{15}$ | | $>10^{17}$–$>10^{18}$ |
| Dielectric Breakdown | KV/mm | 30*** | 15–20 | 28–30 | 15–18 | 20–25 | | |

Note: Values in this table have been compiled from various published sources and do not represent experimental comparison

* –Biaxially oriented Topas® film
** –23 °C, 85% RH
*** –Injection molded plaque

FIG. 16

PERMEABILITIES OF TOPAS® RESINS

| MATERIAL | WVTR | $O_2$ | $N_2$ | $CO_2$ | $CO_2/O_2$ |
|---|---|---|---|---|---|
| TOPAS® 8007 | 0.28 | – | – | – | – |
| TOPAS® 6013 | 0.4 | 392 | 51 | 1264 | 3.22 |
| HDPE | 0.6 | 258 | 94 | 232 | 0.90 |
| LPDE | 0.8 | 1896 | 629 | 8190 | 4.32 |
| PP | 2 | 600 | 182 | 2300 | 3.83 |
| PVC | 2.5 | 30 | 8 | 100 | 3.33 |
| PC | 7.8 | 905 | 220 | 5172 | 5.71 |
| PS | 3.5 | 980 | – | 3500 | 3.57 |
| APET | 6.3 | 25 | 4 | 90 | 3.60 |

UNITS: WVTR: g x 100 $\mu m/m^2$ x 24 hr
GAS: $cm^3$ x 100 $\mu m/m^2$ x 24 hr x bar

FIG. 17

Chemical Resistance of COC Polymers

Because of their olefinic character, all Cyclic Olefin Copolymer grades are resistant to hydrolysis, acids and bases, as well as to polar solvents such as methanol. Non-polar solvents such as toluene or benzene partially dissolve Cyclic Olefin Copolymers>

The resistance to chemical stress cracking is dependent on the degree of molded-in stress in the part. Therefore, end-use testing is recommended to determine the suitability of Cyclic Olefin Copolymers for specific applications.

Chemical Resistance of Cyclic Olefin Copolymers

| | |
|---|---|
| Soap solution | + |
| Hydrochloric acid, 36% | + |
| Sulfuric acid, 40% | + |
| Acetic acid, >99% | + |
| Nitric acid, 65% | + |
| Caustic soda solution, 50% | + |
| Ammonia solution, 33% | + |
| Methanol | + |
| Ethanol | + |
| Isopropanol | + |
| Acetone | + |
| Butanone | + |
| Benzaldehyde | 0 |
| Methylene chloride | – |
| n-Pentane | – |
| Heptane | – |
| Toluene | – |
| Hexane | – |
| Naphtha | – |
| Oleic acid | – |

Legend

+ = Cyclic Olefin Copolymer usable
0 = Cyclic Olefin Copolymer limited use
– = Cyclic Olefin Copolymer not suitable

FIG. 18

CLEAR CANDLE CONSTRUCTION

BACKGROUND OF THE INVENTION

1. Field of the Invention

The present invention relates to constructions and formulations for candles, particularly candles in which the body of the candle is substantially transparent or translucent.

2. The Prior Art

Candles that are used for informal occasions (i.e., candles that are not used for religious ceremonies or similar formal occasions) are often provided in other than the simple waxy "off white" color. Such candles may often be brightly colored and decorated with the various "add on" forms (e.g., wax forms like grape clusters, etc.). Another format, in which candles may be made in a decorative manner beyond their mere utilitarian function, is to make the candle clear.

It is well known that candles can be made in numerous designs and may come in many forms. Although every candle may vary widely in utility, scent, color, texture and even clarity, they most widely fall into two general categories. These categories are listed and defined below (definitions courtesy of NCA, National Candle Association—www.nca.org).

1. Filled Candles—Those candles produced (filled) and used within the same vessel; and
2. Free Standing Candles—Those candles which are rigid and generally free standing which are to be used on a heat resistant, non-flammable surface or on a candle accessory such as a votive holder or candle stick.

When making either kind of the two general candle types above; manufacturers must consider the formulation characteristics of the fuels to be used. Because a certain candle fuel composition will have certain chemical and physical properties associated with it, the fuel may or may not be well suited for one or both of the above-stated categories.

For example, traditional fuels that are too soft, perhaps whether by having a low melt point or low hardness value, cannot be used in a free standing application because typically they lack sufficient rigidity at certain temperatures or there is the presence of obvious oiliness about the fuel. These too "soft" fuel characteristics are common for very highly fragranced waxes, waxes containing oil and the newer gelled oils. Although it is possible to add ingredients or "additives" to these fuels to help reduce softness or oiliness, this typically increases cost. Therefore softer or oilier fuels, often being cost effective, are most well suited for the "filled candle", i.e., container applications.

Recent developments in gelled oil technology have resulted in candle fuels that are transparent. One form of candle fuel is exemplified by light oil, solidified by rubber-type compounds. One such candle fuel is manufactured and sold by Penreco under the name "Versagel" (formerly known as "Geahlene"). For the purposes of this application, this form of fuel shall be termed "rubberized gel" fuel. Another form of candle fuel is exemplified by an ester-terminated polyamide, blended with a solvent to form a gel. Such a fuel is exemplified in U.S. Pat. Nos. 3,615,289; 3,645,705; 3,819,342; 4,332,548; 4,449,987 and may be referred to generally as "polyamide gel" fuel.

While these fuels have achieved the desirable transparent/translucent characteristic, they have already exhibited limitations in their application to free standing candle types. These limitations are again associated with their inherent physical and/or chemical properties that include lack of rigidity, oiliness, tackiness, or brittleness. These transparent gelled oil candle materials are recognized as being best presented within solid, heat resistant glass or plastic final-use-containers. These same gelled oil candle fuels use polymer type gellants, commonly with caulk, adhesive or rubber formulations which are often very sticky when molten or mixed with oils, rendering themselves as materials not suited for removal from candle molds that are often used to make free standing candles, both due to the removal difficulties, and due to the further propensity of the candles to be easily marred, once the candle has been removed from the mold.

The candle gel known as Versagel (Geahlene) from Penreco is an amorphous blend of block polymer and fuel (hydrocarbon oil) that exhibits a resultant thickened viscosity rendering a nearly solid or semi solid and tacky rigid fuel form at room temperature. Ultimately as the gel is heated by a candle flame, it reaches a temperature range best described as its melting temperature, where dramatic loss in viscosity occurs, allowing the now molten fuel to be wicked up and "fuel" combustion. This viscosity and resultant rigidity of the fuel is also subject to diminish, less dramatically, with increasing exposure to even room temperature conditions over time. This behavior is termed "cold flow" and is exacerbated with the presence of fragrance materials in the formula. Manufacturers address this cold flow problem by using less fragrance additive or by placing a temporary clear plastic lid over the top opening of the candle container, often with an aperture for the wick, to protect the filled candle unit from cold flow should the candle be placed on its side during shipping. This also protects the gel from unsightly fingerprints by restricting consumers curious fingers access to the gel surface. In summary, this gelled oil is subject to having a non-fully self-supporting property and is best suited for insertion into some sort of filled container application. It should be noted that the presence of increasing polymer concentrations can slow the process of cold flow, but such increased polymer concentrations are known to hinder the wicking process of molten fuel, thus producing a smaller, dimmer flame.

Clear polyamide gelled oil fuels are available and also possess high oil concentrations. Being at least partially crystalline in structure, this technology is said to be able to attain rigid gelled oil sufficient for a free standing candle application. However, the literature also suggests that this technology has a history of being prone to fracture, marring, "bleed" or exhibit chemical phase separation in the pool of molten fuel surrounding the wick during burning.

The "bleed" characteristic is more technically known as syneresis, the phenomenon that oil is physically being squeezed out of the candle fuel material because of shrinkage and excessive chemical crosslinking of the polymer in the gelled fuel body. This results in a tactile sensation of being excessively oily with a tendency to accept fingerprints or mar, and subsequently the internal gel matrix becomes increasingly brittle. Polyamide gels in common with candle gel described above are notoriously sticky; containing polymers suited for adhesives and caulking formulations, and is difficult to remove from a candle mold. Because of these properties polyamide gel candle compositions are also widely recognized as being truly suitable for use in a filled candle or solid final use container applications such as glass. Polyamide gels contain comparatively high percentages of gellant to achieve functionality, rendering a cost limitation as well.

The understood behavior of "burning a candle" is easily visualized and most non-technically described as the process upon lighting the wick the candle fuel core becomes molten, fuels the wick and the candle as a whole is "burned down"

with time, where the fuel core surface, wick and flame all remain spacially constant to each other, they burn down leaving a deeper vertical distance relative to top edge the original candle and container. This proceeds until the candle is exhausted or extinguished.

In so being most notably suited for use in solid containers such as glass or heat resistant plastic, the production of a freestanding transparent or translucent candle present several challenges. Manufactures can only approximate this desired design by using a clear glass or solid plastic tube that serves to provide the support or protection for the candle fuel. However, glass tubes being expensive, may crack or shatter in the presence of even slight temperature changes relative to the internal and external boundaries of the candle. Heat resistant solid plastic tubes require short, rigid and transparent qualities. During consumption, this distance down that the candle has burned may eventually hinder the availability of oxygen to get to the flame to support efficient combustion. This may result in the production of unsightly, undesirable and potentially hazardous emissions (known as coking) and flammable soot build up. Subsequent use may become progressively difficult and unsafe, as consumers must hold a match precariously downward to re-ignite the wick and are apt to release the match abruptly to avoid injury. This resultant collection of debris can itself be very unsafe.

An example of a prior art transparent candle having a substantially rigid supporting container is found in Linton et al., U.S. Pat. No. 4,332,548. The candle of the Linton et al. '548 patent includes a transparent candle container made in a heatresistant plastic or glass material. The primary transparent candle composition is that such as is disclosed in Gunderman et al., U.S. Pat. No. 3,819,342. The Linton et al. '548 candle also includes a second lower transparent safety layer which is fabricated from a substantially non-combustible composition so that once the candle has burned down to this lower safety layer, the substantially non-combustible composition material will melt and envelope the wick and any stray particulate material, such as the remains of the wick, remains of matches, etc., which could result in a flaring or sudden explosion of flame. The non-combustible material of the safety disk will thus entrap such extraneous particles as well as the wick remainder and extinguish the candle.

The trend in industry is moving to reduce, eliminate, or optimize the costly "container" as a factor in product cost. One approach to achieve this goal is known as the "refill" concept. Here, a manufacturer sells a filled candle container with an attractive glass, and also sells individual replacement fuel cores (candles) of various scent and color designed for the original glass. This saves the consumer money, having only to discard the spent candle remains of the used candle and not the glass.

While the National Candle Association attributes the #1 safety hazard in the industry as being from injury sustained when consumers remove the "spent candle remains" from containers. Consumers typically use sharp objects to pry the remains and "jab" themselves or the glass shatters and lacerates their hand.

It has long been an ultimate technological goal in the candle industry to provide an "ideal" candle material that is clear, rigid, self-supporting, conducive to fueling and propagating a controlled flame using a wick, can be colored, fragranced, not subject to marring or fingerprinting, or excessive brittleness (shattering).

Many, but not all, of the foregoing goals have been approached or possibly met, through the gelled oils described herein.

To date, however, no such perfect "clear wax" equivalent has been attained, and in each of these "close approaches", where a deficiency in design, performance or economics has been noted, the problem has been addressed through less desirable solutions, such as the plastic cover disks, previously described.

In the pursuit of optimizing container costs, refill concepts abound. To provide consumers with "clear" free-standing candle products, solid coatings, rather than glass or plastic containers, have been proposed to address or overcome the deficiencies of the previously mentioned state-of-the-art gelled-oil fuels.

Several such coatings are described in International Publication WO 98/17243. The components referred to in that reference are preferably polymer resins such as fuel oil gelled with a polyamide or styrene acrylic resin. These candidate materials are described with respect to their ability to meet rigidity and clarity requirements, as well as the materials' propensity to be sufficiently adhered to a fuel body for the purposes of support of the fuel and protection from marring. Pure polyamide type resins were evaluated against pure block-polymer resins to quantify and compare rigidity data. The same relative comparisons were made regarding clarity. Each of the methods used a protocol where molded objects of the respective materials (and others) were made and scrutinized for their performance.

In the attempt to evaluate materials viable for solid candle coatings, 2.5±0.4 mm and 5.5±0.4 mm thickness molds were made of various polymer resins.

Polyamide resin ETPA performed well in clarity, provided the various mars and smudges were diligently polished or removed. Rigidity was quantified as well for this material when a sheet of 3 mm thickness was evaluated horizontally under the effect of gravity. In fact, these and many polymers were evaluated to the extent of understanding their solubility and hardness (brittleness) properties in the search for useable coating candidates. Even styrene based acrylic resins noted for their use in floor enamel products showed interesting data. Provided the dipping, spraying, or other techniques used would allow for proper adhesion to the fuel core or to the inside of a mold, the results indicate that a significant thickness of material would be required to virtually replace a glass container as an approximate simulation, retaining the approximate fragility and mass properties of these containers.

To make the container issues moot; efforts have been made in the prior art to provide a clear/transparent/translucent candle construction. International Application Publication Number WO 98/17243 is directed, in part, to ester-terminated polyamide gel bodies, including transparent candles, in which the fuel core material is a polyamide gel. This reference additionally discloses the use of a solid coating for the fuel core that is a component, preferably a pure gellant polymer (polyamide resin or a styrene acrylic resin). These materials, containing functional or polyfunctional molecular components such as nitrogen or organic acid group based components would have melting points quite close to the melting points of the polyamide gel fuel core material, and would be readily soluble in the pool of molten fuel core material, thus contributing actively to the combustion of the flame, as if a clear solid wax glass replacement had been achieved. Currently no such clear solid wax glass replacement has been disclosed.

In addition, the coating was described as being applied either by spraying, dipping, or by coating the inside of a mold with the coating material, and then pouring the fuel core material into the mold. In any event, while the coating material, being a more pure polyamide resin or acrylic resin, might be somewhat harder and more rigid than the fuel core, such coatings were clearly not considered to be the functional equivalent of a self-supporting container for the fuel core. That is, the brittle crystalline coating may help support the gel fuel core, but the mechanism is more in the manner of the fuel core giving the coating "something to hang onto", in that the coating relies on its stickiness to cling to the fuel core, and less in the manner of a freestanding "container-like" support. In addition, the solid coating, having a thickness in the range of several millimeters, for example, could contribute a significant percentage of the overall weight of the candle unit, adding to the cost, size and other physical limitations, in addition to being potentially brittle or easily marred.

It would be desirable to provide a candle unit that is less susceptible to direct handling concerns (marring by fingerprints, etc.) and general breakage issues.

It would further be desirable to provide a candle unit that is both clear/transparent/translucent, and cleaner burning.

It would also be desirable to provide a more cost effective candle unit having such see-through characteristics.

It would also be desirable to provide a candle unit that has an outer surface that is substantially non-oily, substantially non-tacky.

It would also be desirable to provide a candle unit that can be used independently of external or separate discrete receptacles, that can be removed from a mold easily, that is relatively free from cold flow (at typical ambient room temperatures), and does not require the use of an inserted supporting disk, as previously described.

An additional consideration in the manufacture of candles is the known characteristic of "conventional" opaque wax candles to produce larger flames and thus stronger light, than comparatively sized clear or translucent gel candles.

As such, it would also be desirable to provide a gel candle that is capable of producing an improved quality of light, for its size, so that its limited light emissions can be exploited to maximize its overall rumination to more closely approximate a comparatively sized conventional wax candle.

These and other desirable characteristics of the present invention will become apparent in view of the present specification, claims and drawings.

SUMMARY OF THE INVENTION

The present invention is directed, in part, to a candle unit, comprising a fuel core, fabricated from a flammable fuel material, the fuel material having a fuel core melting temperature range. A wick is embedded in the fuel core, for drawing up molten fuel material, for supporting a candle flame. A film surrounds at least a portion of the fuel core, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle, around the candle flame, without immediately causing the film to become non-self-supporting, and a portion of the molten fuel core material is consumed, so that an upper surface of the pool is vertically spaced from a top edge of the film.

As the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

The film, according to one embodiment of the invention, may be fabricated from at least one material that, when molten, is not readily soluble in the molten fuel core material. The film may be fabricated from at least one layer of material selected from the group consisting of: cyclic olefin copolymers, polyhedral oligomeric silsesquioxanes.

The film may have a single layer. Alternatively, the film may have at least two layers. The at least two layers may be fabricated from different materials. At least one of the at least two layers may be fabricated from at least one of the materials in the group consisting of: cyclic olefin copolymers, polyhedral oligomeric silsesquioxanes; and at least one of the at least two layers is fabricated from at least one of the materials in the group consisting of: polypropylene.

Preferably, the film has one of the following characteristics: transparent, translucent, opaque.

The film may include at least one active ingredient from the group consisting of: fragrance materials, air freshener materials, insect repellent materials, flame retardant materials, dyes, pigments, plasticizers.

The present invention is also directed, in part, to a candle unit, comprising a fuel core, fabricated from a flammable fuel core material, the fuel core material having a fuel core melting temperature range. A wick is embedded in the fuel core, for drawing up molten fuel core material, for supporting a candle flame. A film surrounds at least a portion of the fuel core, the film being fabricated from at least two layers, fabricated from different materials, the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle, around the candle flame, without immediately causing the film to become non-self-supporting, and a portion of the molten fuel core material is consumed, so that an upper surface of the pool is vertically spaced from a top edge of the film.

As the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

Each of the at least two layers of the film are not readily soluble in the fuel core material. Preferably, at least one layer of the film may be fabricated from a material selected from the group consisting of: cyclic olefin copolymers, polyhedral oligomeric silsesquioxanes. At least one layer of the film may be fabricated from a material selected from the group consisting of: polypropylene. The film has one of the following characteristics: transparent, translucent, opaque.

The film preferably includes at least one active ingredient from the group consisting of: fragrance materials, air freshener materials, insect repellent materials, flame retardant materials, dyes, pigments, plasticizers.

The invention also is directed, in part, to a method for making a candle unit, comprising the steps of:

forming a supporting film for a candle, the supporting film being substantially self-supporting at ambient room temperature, forming a fuel core and positioning a wick in the fuel core material, substantially surrounding the fuel core with the supporting film;

the fuel core having a melting temperature range, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

The supporting film is further fabricated from at least one material that is not readily soluble in molten fuel core material.

The step of forming a supporting film further comprises the step of fabricating the supporting film from a material from the group consisting of: cyclic olefin copolymers, polyhedral oligomeric silsesquioxanes. The supporting film may have a single layer. Alternatively, the supporting film may have at least two layers. The at least two layers may be fabricated from different materials. Preferably, each of the at least two layers of the supporting film are not readily soluble in the fuel core material.

Preferably, at least one layer of the supporting film is fabricated from a material selected from the group consisting of: cyclic olefin copolymers, polyhedral oligomeric silsesquioxances. At least one layer of the supporting film may be fabricated from a material selected from the group consisting of: polypropylene.

The film has one of the following characteristics: transparent, translucent, opaque. The supporting film may include at least one active ingredient from the group consisting of: fragrance materials, air freshener materials, insect repellent materials, flame retardant materials, dyes, pigments, plasticizers.

The steps of forming a supporting film for a candle, forming a fuel core and positioning a wick in the fuel core material, and substantially surrounding the fuel core with the supporting film, further comprise the steps of:

forming the supporting film into a container shape, pouring fuel core material into the container shape and positioning the wick in the fuel core material; and permitting the fuel core material to solidify, at least partially.

The invention is also directed to a method for making a candle unit, comprising the steps of:

forming a supporting film for a candle, the supporting film being substantially self-supporting and formed from at least two layers, fabricated from different materials;

forming a fuel core and positioning a wick in the fuel core material, substantially surrounding the fuel core with the supporting film;

the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

Preferably, each of the at least two layers of the supporting film are not readily soluble in molten fuel core material. The step of forming a supporting film preferably further comprises the step of forming the supporting film from a material from the group consisting of: cyclic olefin copolymers, polyhedral oligomeric silsesquioxanes. Preferably, at least one layer of the film is fabricated from a material selected from the group consisting of: cyclic olefin copolymers, polyhedral oligomeric silsesquioxanes. Preferably, at least one layer of the film is fabricated from a material selected from the group consisting of: polypropylene. Preferably, the film has one of the following characteristics: transparent, translucent, opaque.

The film may include at least one active ingredient from the group consisting of: fragrance materials, air freshener materials, insect repellent materials, flame retardant materials, dyes, pigments, plasticizers.

The steps of forming a supporting film for a candle, the supporting film being substantially self-supporting, forming a fuel core and positioning a wick in the fuel core material, and substantially surrounding the fuel core material with the supporting film, further comprise the steps of:

forming the supporting film into a container shape, pouring fuel core material into the container shape and positioning the wick in the fuel core material; and permitting the fuel core material to solidify, at least partially.

The invention is also directed to a method for forming a cased article, comprising the steps of:

forming a casing from a self-supporting film unit;

pouring a liquid gel material into the casing; wherein the self-supporting film structure is fabricated from one or more materials, each of which is insoluble in the liquid gel material.

The self-supporting film structure may be fabricated from at least two layers. At least one of the at least two layers may be a material from the group consisting of: cyclic olefin copolymers, polyhedral oligomeric silsesquioxanes; and another of the at least two layers is fabricated from the group consisting of polypropylene.

The invention is also directed to a method for forming a cased article, comprising the steps of:

forming a casing from a self-supporting film structure; and pouring a liquid gel material into the casing; wherein the self-supporting film structure is fabricated from one or more materials, wherein the self-supporting film structure is fabricated from at least two layers.

At least one of the at least two layers may be a material from the group consisting of: cyclic olefin copolymers (etc.); and another of the at least two layers is fabricated from the group consisting of polypropylene.

The self-supporting film structure may be fabricated from one or more materials, each of which is not readily soluble in the liquid gel material.

The invention is also directed to a method for forming a cased article, comprising the steps of:

forming a gel structure having an exterior surface; and forming a substantially self-supporting film in one or more sheet portions;

wrapping one or more sheet portions of the substantially self-supporting film around at least portions of the gel structure;

joining adjoining edges of the one or more sheet portions, to form a casing surrounding at least a portion of the gel structure.

The self-supporting film structure may be fabricated from at least two layers. At least one of the at least two layers is a material from the group consisting of: cyclic olefin copolymers, polyhedral oligomeric silsesquioxanes; and another of the at least two layers is fabricated from the group consisting of polypropylene.

The self-supporting film structure may be fabricated from one or more materials, each of which is substantially insoluble in the liquid gel material.

In an embodiment of the invention, each of the film and the fuel core has one of the following characteristics: transparent, translucent. In an embodiment of the invention, the film has a surface that has been contoured to form a Fresnel lens.

The present invention is also directed to a candle unit, comprising a fuel core, fabricated from a flammable fuel material, the fuel material having one of the following characteristics: clear, translucent, transparent; and having a first index of refraction. A wick is embedded in the fuel core, for drawing up molten fuel material, for supporting a candle flame. A film surrounds at least a portion of the fuel core, the film having one of the following characteristics: clear, translucent, transparent; and having at least a second index of refraction. The fuel core and the film together forming a candle body. The indicies of refraction of the fuel core and the film are operably configured so that upon lighting of the candle, at least a portion of the light radiated from the flame enters the fuel core and is reflected and/or refracted within the fuel core, prior to emanation as light emanating from the candle body.

BRIEF DESCRIPTION OF THE DRAWINGS

FIG. 11 is a chart illustrating typical properties of a film material that may be used in preferred embodiments of the invention.

FIG. 12 is another chart illustrating typical properties of a film material that may be used in preferred embodiments of the invention.

FIG. 16 is another chart illustrating various typical properties of a potential film material that may be used in preferred embodiments of the invention, compared to selected other materials.

FIG. 17 is a chart illustrating permeabilities of variants of a potential film material.

FIG. 18 is a chart illustrating chemical resistance of cyclic olefin copolymers.

DETAILED DESCRIPTION OF THE DRAWINGS

Figure 1:
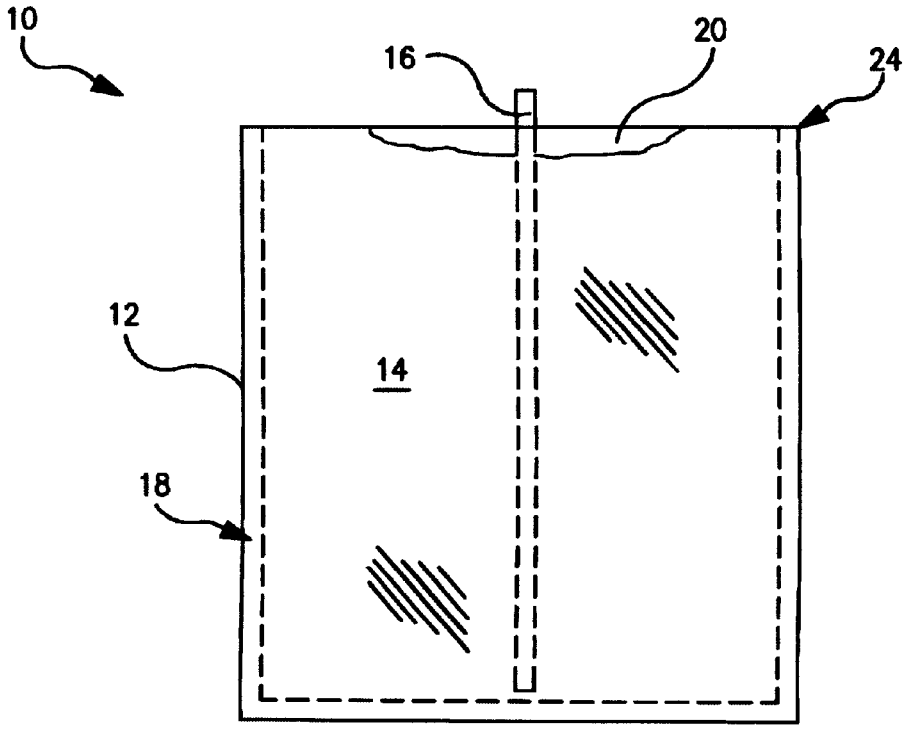
FIG. 1 is a schematic side elevation of a candle according to the present invention.

While this invention is susceptible of embodiment in many different forms, there are shown herein in the drawings and will be described in detail, specific embodiments, with the understanding that the present disclosure is to be considered as an exemplification of the principles of the invention and is not intended to limit the invention to the embodiments illustrated.

Figure 2:
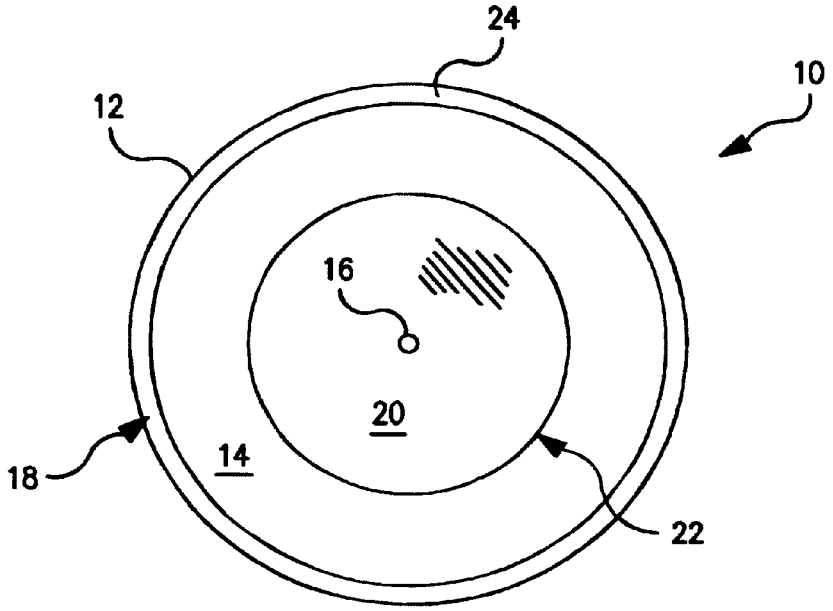
FIG. 2 is a top plan view of the candle of FIG. 1, according to the present invention.

FIGS. 1 and 2 illustrate side and top views of a candle of a general configuration constructed according to the principals of the present invention. Candle 10 has a body 12 that is formed from a fuel core 14, containing a wick 16, and a surrounding film 18. The relative thickness of film 18 as shown in FIGS. 1 and 2 has been exaggerated, to facilitate illustration of the invention. It is to be understood that the actual thickness of film 18, relative to candle body 12 as a whole, is substantially less than that illustrated, as further described herein.

When the candle is initially lit, a region of the fuel core melts to form a pool 20 that has a generally circular periphery 22. The depth and diameter of the pool may vary during the duration of burning of the candle, as the fuel core material is consumed.

While candle 10 is shown as having a circular cross section, other configurations, such as elliptical or even polygonal may be employed.

Fuel core 14 is preferably fabricated from a transparent candle fuel material. Numerous such compositions are known in the prior art, such as may be found in Rogers et al., U.S. Pat. No. 3,797,990; Felten et al., U.S. Pat. No. 3,615,289; Lincoln et al., U.S. Pat. No. 4,332,548; Lindower, U.S. Pat. No. 4,449,987; Elsamaloty, U.S. Pat. No. 5,578,089; and Gunderman, U.S. Pat. No. 3,819,342.

One possible fuel material than may be used in preferred embodiments of the present invention is presently sold under the name "Versagel" (formerly sold as "Geahlene®") sold by Penreco, Houston, Tex. This is a gelled fuel oil, in which the gellant is a rubber material, sold under the name Kraton®. There are at least three grades of this material, CLP, CMP and CHP, ranging in rigidity from lowest to highest. In one preferred embodiment of the invention, the thinnest grade of this material would be used. Other fuel materials may be used, if desired.

Because the candle of the present invention does not rely upon the fuel core to supply strength and self supporting characteristics, the specific composition of the fuel core material is not critical, except insofar as the melting range and solubility characteristics of the fuel material and the film must be compatible, as discussed in further detail herein. Accordingly, further detailed discussion of the fuel material is not believed necessary in order to provide an understanding of the invention to one of ordinary skill in the art.

Fuel core 14 may be molded, extruded, or otherwise formed according to known candle-making techniques. Alternatively, the fuel core material may be poured into a previously fabricated "container" of film material, and allowed to "set" insofar as the fuel core material is capable of setting.

Film 18 surrounds fuel core 14 to provide support for the transparent fuel core material, which fuel core material may be not completely rigid at room temperatures and may soften further as a result of conducted heat when the candle is being burned. Accordingly, the film 18, if examined as a separate body apart from its integration into candle 10, may form a generally flexible material but one that is substantially self-supporting, when formed as a "container", into which the fuel core may be positioned, or even poured in molten state. In addition the material of film 18 must be sufficiently non-stretchable, so as to preclude deformation by the weight of the fuel core material and prevent stretching in either a longitudinal transverse or circumferential direction. Film 18, in addition, is preferably rendered non-flammable, but meltable material, so that its substance as it melts, as described in further detail herein, does not provide fuel to the candle flame or spontaneously combust during use of the candle.

Figure 8:
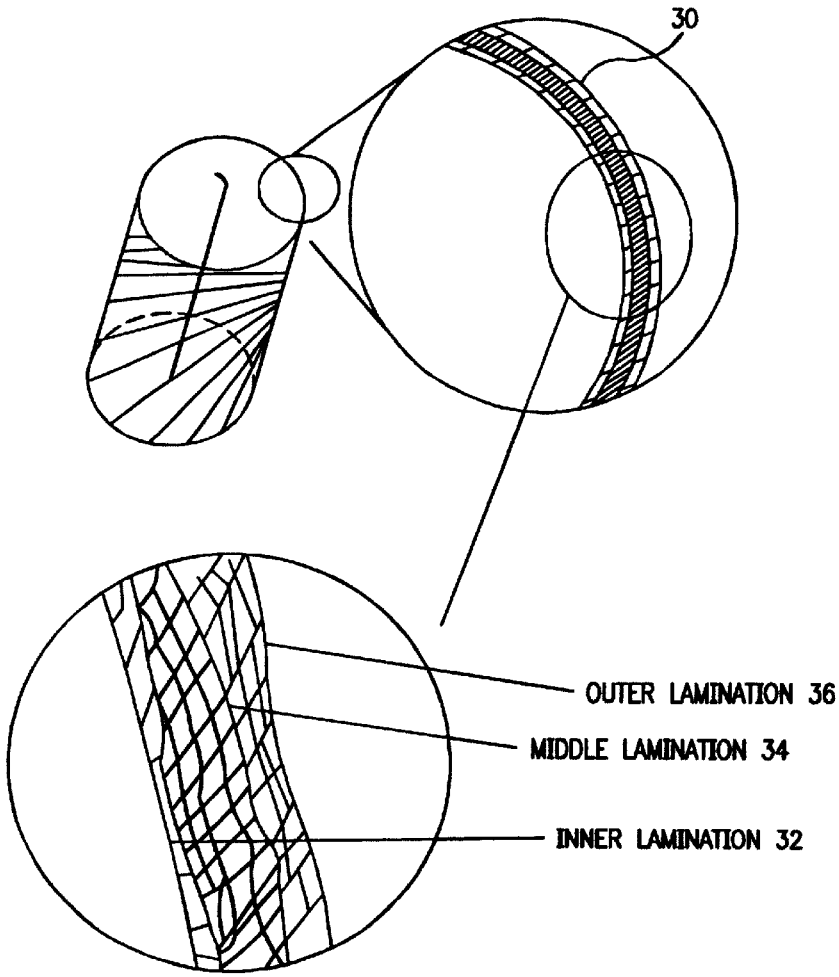
FIG. 8 is an illustration of an alternative embodiment of the invention, in which the film surrounding the candle fuel material core has three layers.
Figure 9:
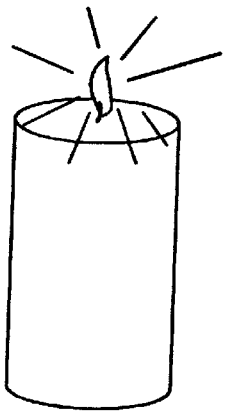
FIG. 9 is an illustration of a conventional candle, illustrating the pattern of illumination.

Preferably, film 18 has an overall thickness such that it forms only a small fraction (e.g., around 1% or less) of the total mass of the candle. For example, the film preferably may have a total thickness in the range of approximately 0.1 mm–1.0 mm, although slightly greater or lesser thicknesses are also contemplated. Film 18, according to the present invention, may be formed from a single layer (as shown in FIGS. 1 and 2), or may be fabricated from two or more layers of similar or different materials (as shown in FIG. 8). In an embodiment in which two or more layers are provided, various combinations of flexible, rigid, or at least longitudinally stiff layers may be employed, so long as the composite film, when shaped as desired, is capable of providing the desired support for the fuel core.

Film 18 preferably may be fabricated from such materials that it can behave as a membrane, in that it may be at least partially porous, to permit the emission of fragrance vapors, for example, if so desired.

In a single layer film embodiment, the film may be fabricated from materials such as cyclic olefin copolymers ("COC"). Such materials may be obtained from Ticona, of Summit, N.J., and sold under the trademark Topas®. Cyclic olefin copolymers are obtained through a catalytic reaction of norbornene and ethylene, two substantially different monomer materials. Norbornene is a bicyclic olefin, whereas ethylene is a non-cyclic olefin. High clarity, low optical distortion, low density, moisture barrier, and resistance to hydrolysis, polar organic materials, acids and bases characterize a cyclic olefin copolymer. The specific numerical values for these various characteristics may be modified by varying the proportion of norbornene (m) to ethylene (n) in the resultant cyclic copolymer.

The general chemical formula for a COC is given by:

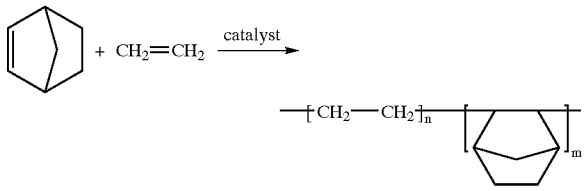

One advantage of using COC materials is that, unlike the polyamide or acrylic resin coatings used in the previously-mentioned WO 98/17243 reference, for example, the COC materials employ no nitrogen, aromatic components, or have high solvent content that could be highly flammable and thus contribute to combustion. COC's are also insoluble with respect to the fuel core materials. This prevents mixing with the molten fuel core material, also preventing contribution to combustion and in fact, causes the melting film material to "retreat" from the flame.

FIGS. 11–19 are charts that provide various properties of various grades of Topas® cyclic olefin copolymers, some in comparison to other materials. The Topas® cyclic olefin copolymers were originally developed as alternative packaging materials for the food and pharmaceutical industries.

Cyclic olefin copolymers can be solid and potentially brittle, in the thicknesses (e.g., around 3 mm or greater thickness) contemplated for the coatings used in the PCT publication WO 98/17243, previously discussed. However, in the considerably thinner film contemplated for the present invention, it is believed that these materials are more than sufficiently flexible to provide relatively shatter-resistant, yet strong supporting containment of a fuel core material, and may be formed as sheets, that may be wrapped around pre-formed more solid fuel core structures, or vacuum or blow-molded or otherwise worked into pre-formed "containers" into which liquid fuel core material can be poured.

Another class of materials that may be selected for use as the base layer of the film are called polyhedral oligomeric silsesquioxanes (POSS). Such materials are presently available from Hybrid Plastics of Fountain Valley, Calif. The general formula for a POSS is:

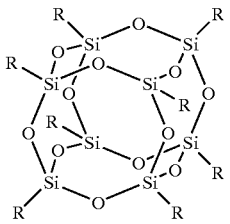

This material can similarly be created in sheet form, and is clear. Having a selectively variable molecular weight, characteristics such as density, hardness and softening/melting temperature can be manipulated. In addition, these materials are flame retardant. It is contemplated that this material can be used as the sole constituent of a film layer, or it can be mixed into another material, such as a COC, or it can be chemically grafted into the molecules of another material such as a COC It may be desirable to apply one or more covering layers on one or both sides of the base layer of the film material. This covering layer(s) may be used to help resist cracking, or to influence other aspects of the behavior of the film.

As more layers of differing materials are employed in the film, more and varied types of performance characteristics may be provided for the film. It is also important to the function of the film of the present invention that preferably each layer of the film exhibit some similar characteristics, such as having melting/softening ranges that are approximately the same, and being not readily soluble in molten fuel core material. Other characteristics of the various film layers may differ, as addressed herein.

In a double layer film embodiment, one layer of the film may be fabricated, for example, from a COC or other material having a similar melting/softening range, similar solubility relative to the fuel core material being used, and similar hardness and flexibility. The other layer of the film may be a covering (or lining) layer fabricated from a material such as polypropylene or similar material, so long as the covering layer has an appropriate softening temperature range, solubility and burning characteristics, and a high degree of flexibility. For example, the covering layer should have a softening temperature range that is relatively close to the softening temperature range of the COC, and certainly closer to that of the COC layer than that of the fuel core material. Likewise, the covering layer preferably should not contribute to burning or support a flame, or be readily soluble in the particular fuel core material that is used. A plasticizer material may be used as the covering layer.

The covering layer may be coextruded to the base COC layer, or it may be later applied and bonded to the base layer.

In one preferred embodiment, in which a COC is used as the base layer, any potential brittleness of the COC may be mitigated by a covering/lining layer of polypropylene. This permits combined thin COC and PP layers, for example, preferably having a total thickness in the range discussed above, to be manipulated by such techniques as wrapping a membrane-like sheet of film around a gel candle fuel core, and joining the edges of the sheet by gluing or welding. Another manipulation technique enabled by the use of a two layer film is vacuum or blow molding, which may be used to form a free-standing cup or other support, into which molten, or at least liquid, candle fuel core material may be poured and permitted to set.

An example of one such combination would be to provide a selectively permeable layer (e.g., to selectively permit the passage of fragrance, air freshener or insect repellent materials), and a microporous surface layer. In a two-layer film, one or both of the layers may be provided with the necessary strength/stiffness characteristics to provide support for the fuel core.

In an alternative two-layer embodiment of the invention, both layers may be fabricated from COC's or POSS's but of different proportions of the underlying constituents. Such differently base layer materials (such as the differently composed COC's evidenced by the different grades of film described in FIG. 11) can thus have varying physical, mechanical, thermal, optical and processing properties, which may be selected to address the requirements of the particular application. One such situation may be that it may be desirable for the film to exhibit a particular behavior, as the candle unit burns down. For example, as the softening/melting temperature ranges of the components of the film are approached, as a result of the burning down of the candle, the relative COC layers may be selected so that either the inner or the outer layer softens first, causing the film to curl inwardly or outwardly, as desired.

In an alternative preferred embodiment of the invention, as illustrated in FIG. 8, film 30 may be formed from three layers: inner layer 32, middle layer 34, and outer layer 36.

According to one preferred embodiment of the invention, inner layer 32 may be polypropylene, middle layer 34 may be a COC, and outer layer 36 may also be polypropylene. In such an embodiment, the thicker middle layer of COC may provide the bulk of the film volume, thus providing the bulk of the support strength, while the inner and outer PP layers may again provide resistance to cracking of the COC layer. Preferably, the total thickness of the combined layers will again be in the range of thicknesses previously discussed, though likely in the higher end of the range.

Other possible materials for the inner, middle and outer layers may be used, and may be derived from the classes of materials described with the single and double layer film embodiments.

Another example of a three layer film would be one in which the first layer is a flame retardant layer or a layer of material that does not join the pool of molten fuel material, because it sublimes directly to a gas. the second layer is the previously described cyclic olefin copolymer layer, and the third layer, in addition to providing support for the potentially brittle COC layer, may provide an "optical" substrate (i.e., one that accepts and retains printing of letters, numbers or symbols.), for decoration. Other combinations are also possible.

Film 18 may both circumferentially surround the fuel core, and may extend across the bottom of the core to form a "foot" for the candle. Alternatively, film 18 may only surround the "sides" of the column. Film 18 may be co-extruded simultaneously with fuel core 14. Alternatively, film 18 may be a pre-formed cup- or tube-like container, permitting fuel core 14 to be poured into it. Such a pre-formed cup may be formed by vacuum molding, drawing, or other similar process. As another alternative, film 18 may be formed into sheets or tubes and applied to already formed fuel cores. In a still further alternative, film 18 may be coated, vapor-deposited, or otherwise formed in situ on a pre-formed fuel core. In order to facilitate placement of the film on the fuel core, the film may be formed as uncured layers that are later cured, by application of air, UV light, heat and/or pressure.

A candle constructed in accordance with the present invention will have burning and melting characteristics as described hereinafter in accordance with FIGS. 3–7.

Figure 3:
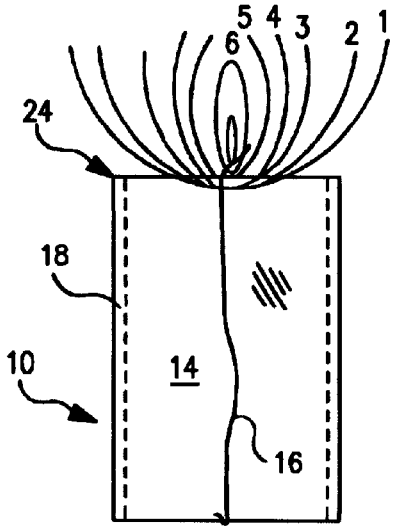
FIG. 3 is a schematic illustration of the flame temperature regimes of a justlit candle, in accordance with the principles of the present invention.

Referring to FIG. 3, when a candle in accordance with the present invention is first lit, the top of the candle is flat, and the fuel core is initially unmolten, with just the tip of the wick projecting upwardly. As burning progresses, a pool 20 of molten fuel core material forms around the wick, and is drawn, by capillary action, up the wick, to be consumed by the flame. Pool 20 initially will have a width defined by edge 22 that extends radially from wick 16, toward film 18. Ultimately, with an appropriately selected fuel core material, the edge 22 of pool 20 of liquid fuel core material of a certain diameter, depending upon the particular fuel core material, may and typically will extend the complete diameter of the core, to the circumferentially surrounding film 18.

Film 18 will be selected of materials, as described hereinabove, that will have a temperature range over which the layer(s) of the film will soften and ultimately collapse. The overall film may or may not completely melt and become liquid. The fuel core material and the film materials will be selected so that the fuel core material will be consumed and burned down, before the adjacent film material has softened sufficiently to undergo collapse or curling, etc. Accordingly, the fuel core material itself may soften and become liquid over a range of temperatures, in which the highest temperature in the range is actually higher than the lowest temperature at which softening of one or more of the film layers begins, but not higher than (or even equal to) the collapse or curl temperature(s) of the film, so that dripping of molten fuel core material is avoided.

Figure 7:
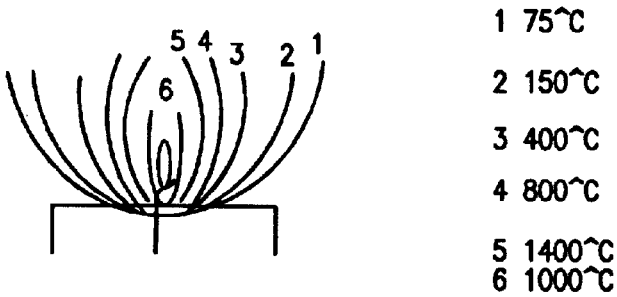
FIG. 7 is a still further schematic illustration of a burning candle of the present invention, illustrating a possible temperature gradient range present in the aura of the candle flame.

As indicated in FIG. 7, a candle flame is in reality a visible location of combustion with an invisible aura of generated heat that extends across the width of the candle. A wide-ranging temperature gradient exists, with the lowest temperatures, at the locations in the aura approximately radially farthest from the center of the flame. The temperature of the aura increases with proximity to the flame, up to a radial position close to, but not actually coincident with the wick, where the maximum temperature is reached. The region coincident with and immediately adjacent the wick actually has a temperature gradient slightly lower than the region slightly farther out from the wick (though still quite elevated in temperature).

Figure 4:
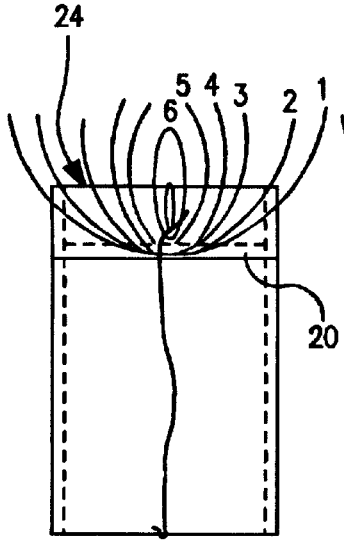
FIG. 4 is a schematic illustration of a candle of the present invention, according to claim 3, showing melting and downward consumption of a molten fuel core, exposing the film to flame.
Figure 5:
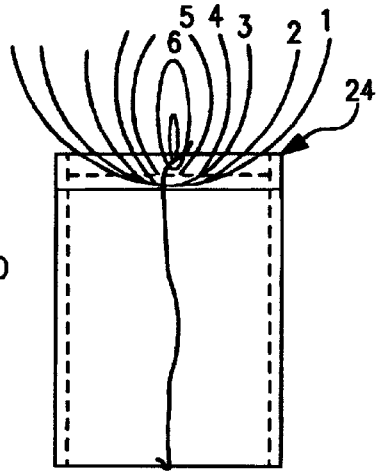
FIG. 5 is a schematic illustration of the candle of the present invention, according to claims 3 and 4, showing how the exposed film top edge retreats, upon exposure to higher temperature regions of the aura of the flame.
Figure 6:
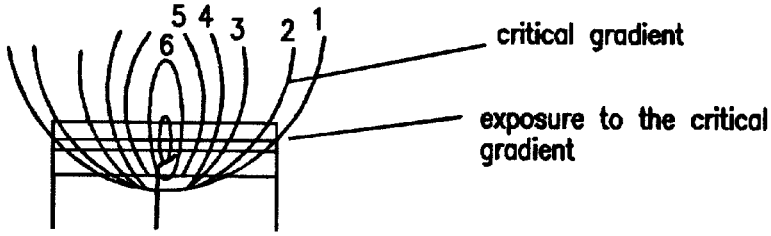
FIG. 6 is a further schematic illustration of a burning candle of the present invention.

As the molten fuel core material is consumed by combustion, the candle burns down. The level of the pool of molten fuel core material drops, although the depth of the pool may typically remain substantially constant. In accordance with the dropping level of the pool level, the flame and aura will drop down, while retaining substantially the same shape, as indicated in FIG. 4. Initially, as the pool level drops, top edge 24 of film 18 comes into direct contact with the high temperature gradients in the aura of the flame, initially making contact with the lowest gradient 1 of the aura (e.g., approximately 65° C.–75 C). In the preferred embodiment of the invention, film 18 will have a softening/melting temperature range that, while possibly overlapping the temperature regime of the lowest temperature region of the candle flame (e.g., 70° C.–85° C.), has a collapse or failure-through-softening temperature range that is higher (preferably considerably higher) than that (e.g., >75° C.–85° C.). Thus, the fuel core material will be melted and burned down, and the edge of the film exposed to the lowest temperature gradient of the flame aura, but not melted or collapsed, yet.

Gradually, the top edge 24 of the film 18 will pass through higher and higher temperature gradients of the flame aura, until a gradient is attained that has a temperature range that is above the collapse or failure-through-softening temperature range of the film, or of at least one layer of the film. The film may or may not completely melt, depending upon the materials selected for the film.

This is illustrated in FIG. 4, in which the top edge 24 of the film has passed from temperature gradient 1 to temperature gradient 2. Temperature gradient 2 may be at approximately 150 C. At this point, the material of film 18 softens and falls away (possibly curling in or out, as described herein) or even melts. If the film simply collapses, but does not melt, then its "top edge" drops down, back toward the lower temperature gradient of the aura. Similarly, if the film actually melts, the top edge of the film will recede toward the lower temperature gradient of the flame.

In either event, presuming that the candle flame burns at a uniform rate, the "retreat" of the top edge of the film will be a more or less continuous process, once it has begun. until the candle fuel is completely consumed, or the flame is extinguished.

If the film (due to the material(s) selected) is in fact expected to fully melt and become liquid, the molten film material should remain liquid and create a second pool, surrounding pool 20. In order to achieve this, the material(s) from which film 18 is fabricated would all be not readily soluble in the particular molten candle fuel material selected for the particular application. In the present application, COC's are believed not to be readily soluble in either rubberized oil fuels or polyamide fuels. Accordingly, the molten film material would not mix significantly with the pool of molten fuel material, would not be significantly transported to or drawn up the wick, and would not contribute to combustion.

As mentioned, this will be true, if the film materials described above are used, with virtually all potential fuel core materials. Some fuel materials do exist, that have strong solvent components (e.g., alcohols, kerosenes, acetones), but such solvent materials are excessively flammable (compared to candle use) and fuel cores having such solvent contents would not be considered suitable fuel core materials for a household candle.

To mitigate the unlikely event that some molten film material does get to the wick, the film material should be selected from a material that either does not readily support flame, or should include a flame retardant component. Indeed, such a flame retardant component could actually slow the melting process, or could be released from the film once a certain temperature regime is attained, so as to extinguish the flame. COCs are believed to inherently have some flame retardant characteristics, as are the POSS materials previously described.

It may also be desired to apply such additives to the outer surface of one or more of the layers. An interesting additive material, which is known in the candle art commercially as Candle Lustre, has heretofore been used strictly as a polishing material, for removing mars from conventional glossy wax candle structures. It has been found that application of this material to films of the present invention (in particular the PP/COC/PP embodiment) has the effect of acting as a plasticizer and as a flame retardant, so that upon burning and consumption of the fuel material, the additive serves to control and eventually assist in extinguishing the flame, before the flame can have an opportunity to ignite or burn the film.

Depending upon the relative characteristics of the film layers, it is possible to select for specific outer or inner layer materials that will have different rates of contraction or expansion upon heating, so that the film may actually be prompted to "curl" toward or away from the molten fuel core material pool, as the film encounters a sufficiently high candle flame temperature regime.

To recapitulate, as the candle burns down (in particular, as the fuel core burns down), film 18 will continuously soften and recede (or melt), so that its topmost region will continuously recede, but preferably with a vertical "gap" between it and the level of the pool.

To achieve this vertical gap, preferably, fuel core 14 is fabricated from a material or combination of materials that has a melting temperature (and thus a temperature that permits the fuel to be supplied to the wick and consumed in the flame, that is substantially below that point in the softening/melting temperature range of the film at which the film retreats from the flame cloud. For example, if fuel core 14 goes liquid at approximately 65° C., then film 18 should not begin to actually retreat (though it may have softened somewhat) before a temperature of, for example, approximately 75° C. or greater. If the melting point of the fuel core is higher, then the film "retreat temperature" should be correspondingly higher, so that a significant, but not excessive, differential (for example, on the order of 3–5 mm) is always present, and the "lagging" behavior of the film will be maintained. A smaller temperature gap may be selected, if desired, based on other considerations. For example, for larger diameter candles, lesser temperature gaps between the fuel melt temperature and the film retreat temperature may be desired, since for a larger candle, it takes longer for the outer periphery of the candle to encounter the higher temperature gradients and heat up sufficiently to soften and melt.

The rate of consumption of the fuel (rate of burning) can be expressed as fuel mass consumed over time. Typically, for conventional fuel gel materials, a consumption rate of burning of 2.5 g/hr would be a typical desired rate. Using this mass per time consumption rate, a volumetric rate of consumption can be determined, once the density of the fuel is known. For example, a typical fuel may have a mass of 0.7 grams per cubic centimeter. The volume of a typical cylindrical candle is expressed by the well-known formula $v=pi\ r^2h$. In turn, knowing the dimensions of a typically cylindrical candle, and presuming a pool of molten fuel material extending substantially completely across the diameter of the candle, a rate of drop of the level of the molten pool can be determined. Consequently, a rate of drop for the flame, and of the specific temperature regimes within the flame can be at least roughly determined. Thus, the rate of exposure of the film wall to the temperature regime sufficient to cause melting of the film, relative to the rate of burning and drop of the molten fuel pool, can be expressed. This information can then be used to select appropriate combinations of fuel core materials and film materials, so that for a fuel having a known rate of consumption, for a candle of known dimensions, the rate at which the fuel core burns down can be determined. This allows one to determine the rate of exposure to the flame aura. By then selecting the appropriate grade of film material, the steady state vertical gap between the pool and the film top region, once burning has commenced, can be approximately determined.

In a multilayer film, one of the film layers may contain fragrance material, air freshener, insect repellant, flame retardant, dyes, pigments, plasticizers (to change softening or melting behavior and/or to reduce brittleness) or other kinds of active ingredients that may be released over time, or are activated as a result of the burning of the candle. Such a layer may be formed as a mesh or otherwise porous material. Film 18 may alternatively contain chemiluminescent (fluor- or phosphorescent) materials. One such fluorescent material that is commercially available is sold under the name Lumi Nova®.

While certain particular materials are described herein for use in film 18, other materials, not specifically mentioned herein, may be employed; depending upon certain characteristics that may be desired. For example, film 18 may be porous (visibly porous), micro-porous (not visibly porous, but with spaces on the order of magnitude of several microns), or entirely non-porous. For example, film 18 (that is, one or more of the layers thereof) may be chemically configured to be selectively porous to preselected materials, such as scenting materials, insect repellent materials, etc., so that the candle would emit the desired scent or insect repellent material, while resisting sweating or intrusion of undesired contaminants from outside. While the present invention is primarily directed to films that are transparent or translucent, if desired, film 18 may be opaque, while still providing the structural advantages and characteristics discussed herein.

Likewise, the physical behavior characteristics of film 18 (e.g., softening temperature range, rate of consumption during burning, etc.) may be modified, to optimize the film response to the burning characteristics, matched to the physical characteristics and dimensions of the particular fuel core to which the film is being applied.

The candle construction of the present invention is believed to have several advantageous features. The use of the supporting film is believed to contribute to the safety and overall performance of the candle. For example, by having a surrounding film that follows the molten fuel core as it burns down, dripping of the fuel is preventing, thus assuring no wasting of fuel. Candles can now be made non-dripping and clear, which is a combination not previously attainable, because typical freestanding gel candles melt, drip or run, and form a pool, wasting fuel.

It is common for candles to be wrapped in a plastic packaging film that is intended to be removed, prior to lighting the candle, in order to prevent uncontrollable burning of the plastic wrapper. Typically, such wrapper plastics produce undesirable, possibly even hazardous fumes, upon burning. Such candles then require warning labels to remind purchasers to remove the plastic film prior to lighting. The present invention provides a candle with a durable outer film that obviates the need for solid containers, plastic wrappers or warning labels, or instruction stickers affixed to the candle itself, which would have to be removed before the candle can be used.

Candles constructed according to the principles of the present invention are believed to be more durable, and more amenable to physical handling, without damage, which lends the use of such candles to "refill" applications (the use of such candles to replace consumed candles in permanent, reusable, holders). Such amenability to re-use was not previously found in gel-type transparent candles, due to the tendency for gel-type candles to exhibit cold flow, and have difficulties in demolding. In addition, because candles of the present invention can permit self-supporting clear candle constructions, without the use of a surrounding plastic or glass tube, with the retreating film top edge feature, adequate supply of oxygen to the flame is not an issue. Thus, reliably clean-burning candle constructions are enabled.

The advantages of the film-encased candle unit according to the present invention are further demonstrated in the embodiment of products, such as votive candles, and the like, in which a candle body may be transported and sold already placed in containers, such as votive glasses. If, for example, a case of prior art gel-type votive candles, during transportation or storage is placed on its side, cold flow may cause some of the candle material to flow out of the respective containers. Accordingly, it has been common practice to place a disc of plastic material, like a plug, over the gel candle surface. This disc is essentially wedged into the top of the container, and may have a central aperture, through which the wick may project. This disc is not intended to be burned, being fabricated from materials that could ignite and produce potentially hazardous gases during burning. Accordingly, such candles should be provided with explicit warnings that removal of the disc is necessary, prior to lighting the candle, for safety reasons.

By completely supporting film a candle fuel core with a film in accordance with the principles of the invention (preferably having the wick extend through the layer of film extending over the top of the candle), the use of such a "shipping disc" and the necessity for removal of same, and of warnings to remind consumers to remove such discs, is eliminated. Upon lighting of such a film-encased candle, the film on the top of the candle will immediately retreat from the flame, melting, but not soluble in the pool of molten fuel material. As the candle continues to burn, the film will retreat to the periphery of the candle, and as the pool of fuel is consumed, will follow the descending fuel pool downward, as described elsewhere herein.

A related advantage also concerns the manufacture, marketing and sales of candles, and indeed of other gel-bodied products, that are intended for "refill" applications. Using again the example of votive candles, it is common practice for votive candles to be packaged and sold, with initial candle bodies sold in reusable glass or plastic holders. In addition, replacement candle bodies are typically sold in units of two or more, in disposable, preformed plastic packages. The formed packages are required to protect the replacement candle bodies, and maintain their shape until they are placed in their respective holders. When the original candle body is consumed, the remains of the used-up candle (usually a bit of wick, a small amount of fuel, and/or other debris) will be cleaned out of the reusable holder. A replacement candle body is then "popped out" of the preformed package. However, such prior art gel candle bodies typically cannot be simply popped out, due to cold flow and sticking. Even the use of pull ribbons, placed under the gel candle bodies, was typically unsatisfactory, because the ribbon would cut into the soft candle body.

In contrast, film-encased candle units constructed in accordance with the principles of the present invention substantially reduce and potentially eliminate the need for such preformed packaging, since little or no additional protection for the candle bodies is required.

The firmness and supporting strength characteristics of the film permits the possibility of the outside of the film being hand-decorated or silk-screened. In addition, designs and indicia of various kinds may be placed on or formed in the film, such as warning statements, logos, graphics, holographic designs, etc., that becomes a permanent part of the candle (as opposed to a sticker or label on the wrapper), that further becomes particularly visible or prominent, upon lighting of the candle.

When film 18 is transparent or translucent, and used in combination with a transparent fuel core, the transparency or translucence permits visible inspection or viewing of bubbles or other inclusions in the fuel core material, or of materials intentionally embedded in the fuel core, such as specially formed shapes or floating or suspended decorations, fabricated from colored fuel material, glitter, or other decorative items.

Figure 10:
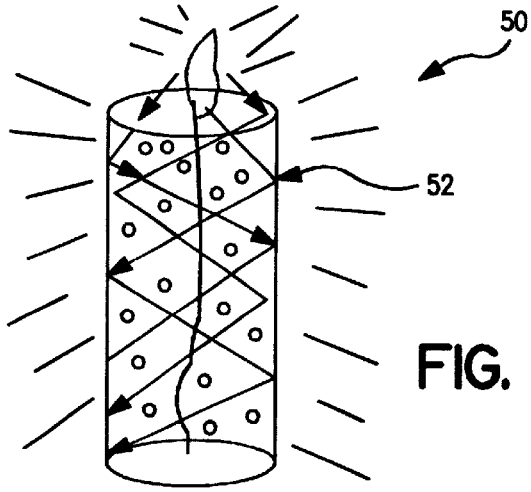
FIG. 10 is an illustration of a candle according to the present invention, illustrating the pattern of illumination, in which due to "fiber optic" characteristics of the candle fuel material core and/or supporting film, light is emitted by the candle body, in addition to the flame itself.
Figure 13:
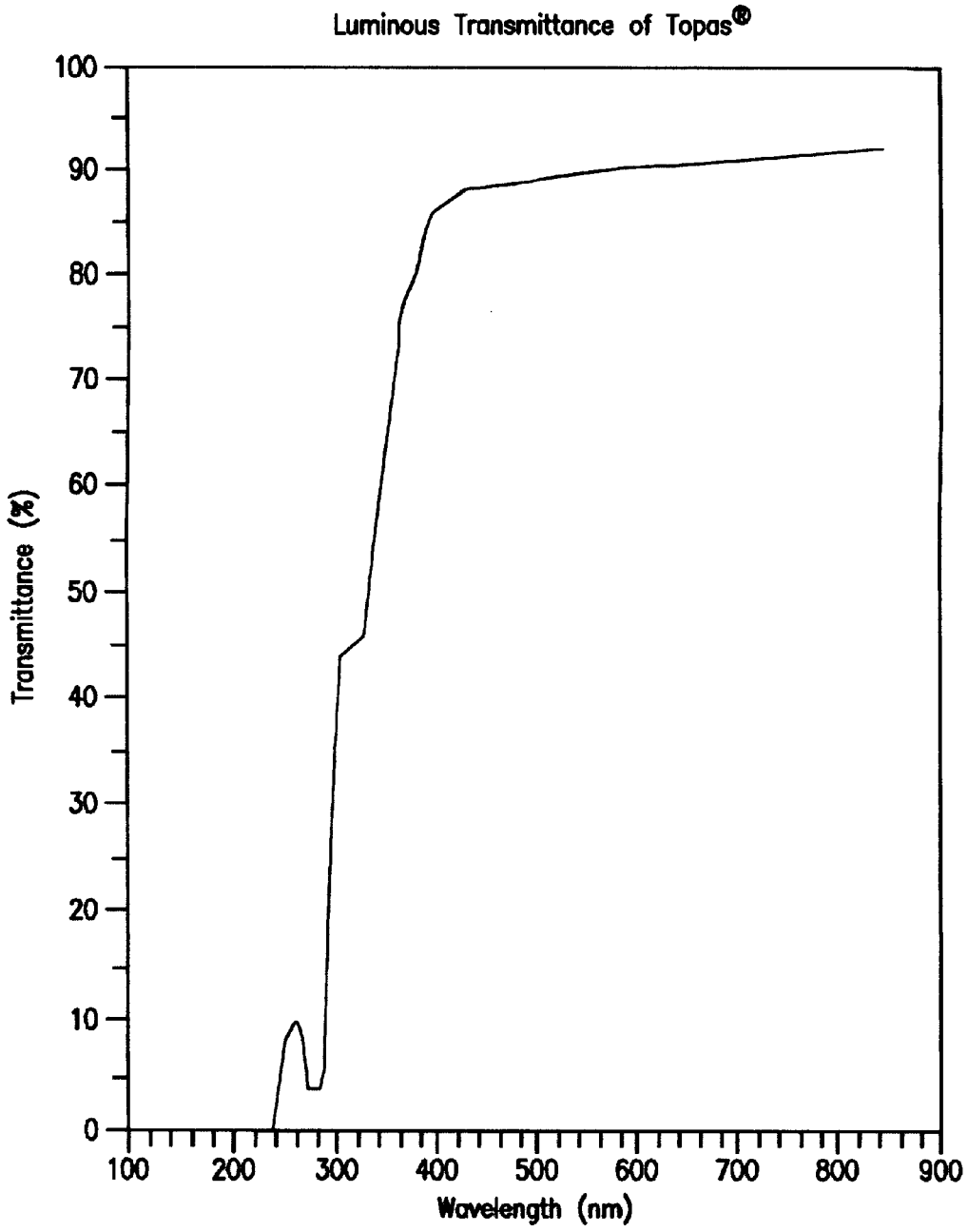
FIG. 13 is a chart illustrating transmittance of a particular potential film component for the present invention.
Figure 14:
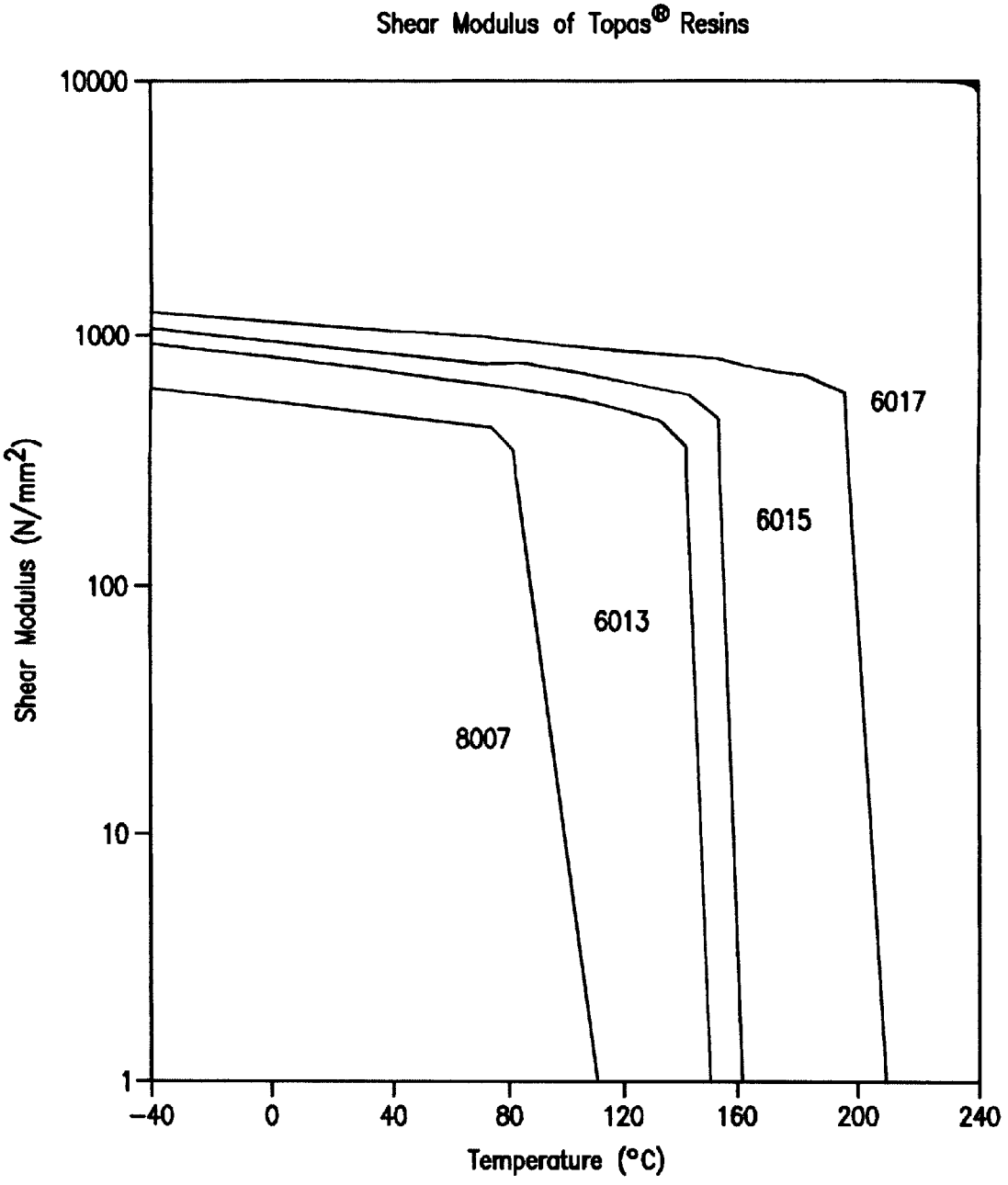
FIG. 14 is a chart illustrating shear moduli for particular potential film component variants for the present invention.
Figure 15:
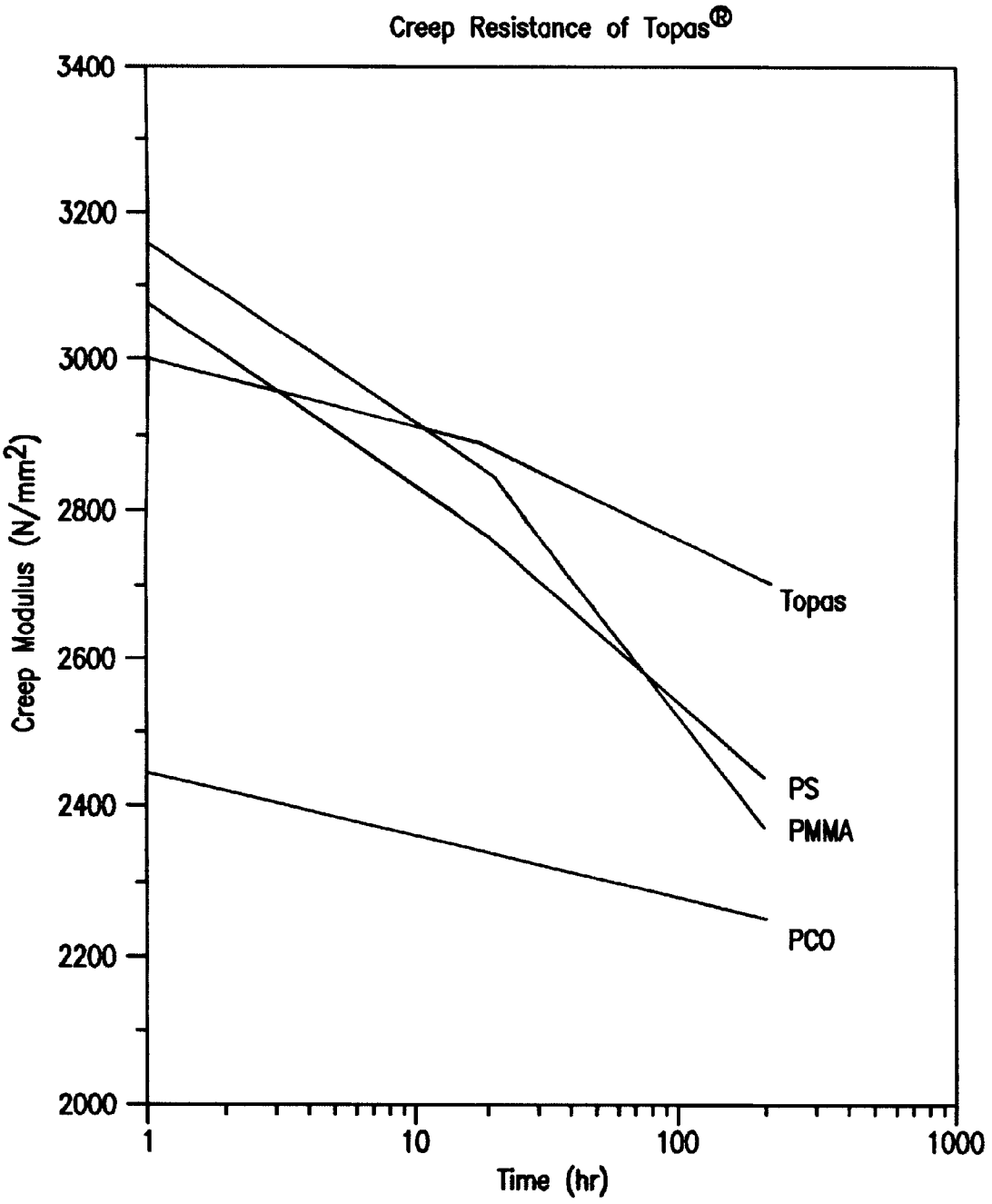
FIG. 15 is a chart illustrating creep moduli for particular potential film component variants for the present invention.
Figure 19:
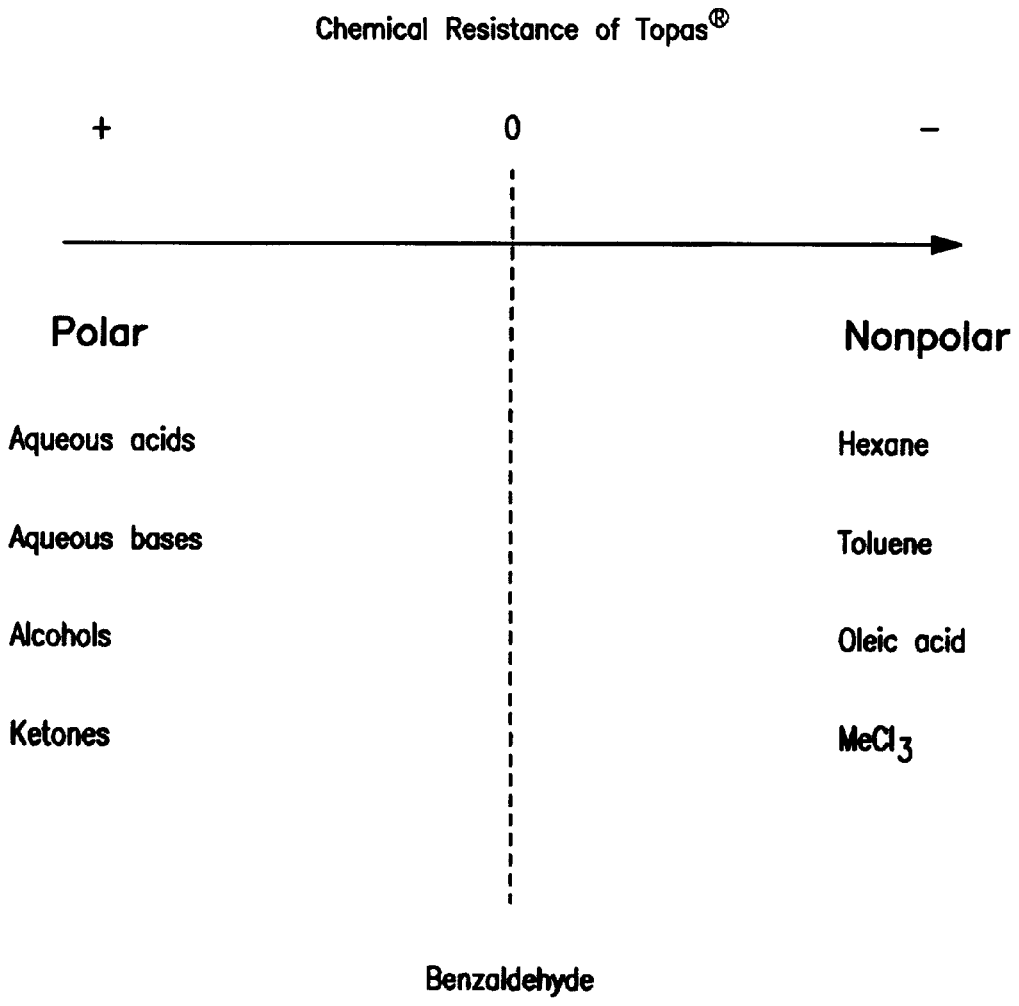
FIG. 19 is another chart illustrating chemical resistance of cyclic olefin copolymers.

One particular variation of the present invention made possible through the principles of the present invention is a "fiber optic" effect candle. Referring to FIG. 8, a conventional candle emits light only from the flame itself. Light that is directed downward is essentially absorbed and muted by the candle body. A transparent candle 50, manufactured in accordance with the principles of the present invention, is shown in FIG. 10. Film material 52 is at least partially reflective on the side "facing" the fuel core (for example, by making sure the index of refraction of the film substantially different from the refractive index of the fuel core). Some of the light from the flame, which of course is emanated in substantially all spherical directions, is directed downward into the transparent fuel core, will not pass immediately out of the fuel core. Instead, the light will be reflected back and forth in the fuel core, creating a glowing effect, as if the "solid" fuel core itself were a light source. The degree of this effect would be controlled by the proportion of light passed by the film/fuel core interface and the amount reflected at that interface, as well as the proportion of light passed by the film/air interface and the amount reflected at that interface. Indeed, it may be possible to so select the materials, such that light may be admitted into the film from the fuel core, and then reflected and refracted back and forth primarily in the film layers, creating a glowing ring surrounding the fuel core. Control over the refractive indices can be obtained, for example, through selection of the appropriate layer materials or combination thereof.

Another variant of the present invention that is permitted by the film construction would be to form the film, prior to filling with fuel, and carve the inside or outside surface or both, with a pattern to form a Fresnel lens. Such contoured lens surfaces are well known for their ability to concentrate and intensify a light source. By forming the film with such a lens surface, the light emanating from the candle body itself (the fiber optic effect) can be even further intensified.

An additional advantageous feature of the present invention is that the film of the present invention will permit its use with soft wax fuel cores or gelled oil fuel cores that are cold flowing and buoyant in water. Thus floating candles can be constructed using soft wax fuel. In addition, clear candle fuel sources, which previously needed glass or plastic containment to sustain shape, can be used in floating environments.

Indeed, the film of the present invention may also be applied to non-candle embodiments, in which a relatively soft, easily marred, non-self supporting or brittle central core could benefit from a surrounding, substantially self-supporting containment film, which may be insoluble with respect to the material of such central core, or otherwise not significantly chemically reactive to it.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A candle unit having a top, comprising:

a fuel core, fabricated from a flammable fuel material, the fuel material having a fuel core melting temperature range;

a wick embedded in the fuel core, for drawing up molten fuel material, for supporting a candle flame;

a film, surrounding at least a portion of the fuel core, the film being fabricated from at least one substantially nonflammable material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

2. The candle unit according to claim 1, wherein the film is fabricated from at least one material that, when molten, is not readily soluble in the molten fuel core material.

3. The candle unit according to claim 1, wherein the film has one of the following characteristics: transparent, translucent, opaque.

4. The candle unit according to claim 1, wherein the film includes at least one active ingredient from the group consisting of: fragrance materials, air freshener materials, insect repellent materials, flame retardant materials, dyes, pigments, plasticizers.

5. The candle unit according to claim 1, wherein the fuel core material is a gelled oil.

6. A candle unit having a top, comprising:

a fuel core, fabricated from a flammable fuel material, the fuel material having a fuel core melting temperature range;

a wick embedded in the fuel core, for drawing up molten fuel material, for supporting a candle flame;

a film, surrounding at least a portion of the fuel core, the film being fabricated from at least one material having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein the film is fabricated from at least one layer of material selected from the group consisting of: cyclic olefin copolymers, polyhedral oligomeric silsesquioxanes.

7. The candle unit according to claim 6, wherein the film has a single layer.

8. The candle unit according to claim 6, wherein the film has at least two layers.

9. The candle unit according to claim 8, wherein the at least two layers are fabricated from different materials.

10. The candle unit according to claim 8, wherein at least one of the at least two layers is fabricated from at least one of the materials in the group consisting of: cyclic olefin copolymers, polyhedral oligomeric silsesquioxanes; and at least one of the at least two layers is fabricated from at least one of the materials in the group consisting of: polypropylene.

11. A candle unit having a top, comprising:

a fuel core, fabricated from a flammable fuel core material, the fuel core material having a fuel core melting temperature range;

a wick embedded in the fuel core, for drawing up molten fuel core material, for supporting a candle flame;

a film, surrounding at least a portion of the fuel core, the film being fabricated from at least two layers, fabricated from different materials, at least one of the materials being substantially nonflammable, the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

12. The candle unit according to claim 11, wherein at least one layer of the film is fabricated from a material selected from the group consisting of: polypropylene.

13. The candle unit according to claim 11, wherein the film has one of the following characteristics: transparent, translucent, opaque.

14. The candle unit according to claim 11, wherein the film includes at least one active ingredient from the group consisting of: fragrance materials, air freshener materials, insect repellent materials, flame retardant materials, dyes, pigments, plasticizers.

15. A candle unit having a top, comprising:

a fuel core, fabricated from a flammable fuel core material, the fuel core material having a fuel core melting temperature range;

a wick embedded in the fuel core, for drawing up molten fuel core material, for supporting a candle flame;

a film, surrounding at least a portion of the fuel core, the film being fabricated from at least two layers, fabricated from different materials, the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein each of the at least two layers of the film are not readily soluble in the fuel core material.

16. A candle unit having a top, comprising:

a fuel core, fabricated from a flammable fuel core material, the fuel core materital having a fuel core melting temperature range;

a wick embedded in the fuel core, for drawing up molten fuel core material, for supporting a candle flame;

a film, surrounding at least a portion of the fuel core, the film being fabricated from at least two layers, fabricated from different materials, the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein at least one layer of the film is fabricated from a material selected from the group consisting of: cyclic olefin copolymers, polyhedral oligomeric silsesquioxanes.

17. A method for making a candle unit having a top, comprising the steps of:

forming a supporting film for a candle, the supporting film being substantially self-supporting at ambient room temperature, forming a fuel core and positioning a wick in the fuel core material, substantially surrounding the fuel core with the supporting film;

the fuel core having a melting temperature range, the film being fabricated from at least one substantially non-flammable material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

18. The method according to claim 17, wherein the supporting film has a single layer.

19. A method for making a candle unit having a top, comprising the steps of:

forming a supporting film for a candle, the supporting film being substantially self-supporting at ambient room temperature, forming a fuel core and positioning a wick in the liquid fuel core material, substantially surrounding the fuel core with the supporting film;

the fuel core having a melting temperature range, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein the supporting film is further fabricated from at least one material that is not readily soluble in molten fuel core material.

20. A method for making a candle unit having a top, comprising the steps of:

forming a supporting film for a candle, the supporting film being substantially self-supporting at ambient room temperature, forming a fuel core and positioning a wick in the liquid fuel core material, substantially surrounding the fuel core with the supporting film;

the fuel core having a melting temperature range, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein the step of forming a supporting film further comprises the step of fabricating the supporting film from a material from the group consisting of: cyclic olefin copolymers, polyhedral oligomeric silsesquioxanes.

21. A method for making a candle unit having a top, comprising the steps of:

forming a supporting film for a candle, the supporting film being substantially self-supporting at ambient room temperature, forming a fuel core and positioning a wick in the liquid fuel core material, substantially surrounding the fuel core with the supporting film;

the fuel core having a melting temperature range, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein the supporting film has at least two layers.

22. The method according to claim 21 wherein the at least two layers are fabricated from different materials.

23. The method according to claim 22, wherein each of the at least two layers of the supporting film are not readily soluble in the fuel core material.

24. The method according to claim 21, wherein at least one layer of the supporting film is fabricated from a material selected from the group consisting of: cyclic olefin copolymers, polyhedral oligomeric silsesquioxances.

25. The method according to claim 21, wherein at least one layer of the supporting film is fabricated from a material selected from the group consisting of: polypropylene.

26. The method according to claim 21, wherein the supporting film has one of the following characteristics: transparent, translucent, opaque.

27. The method according to claim 21, wherein the supporting film includes at least one active ingredient from the group consisting of: fragrance materials, air freshener materials, insect repellent materials, flame retardant materials, dyes, pigments, plasticizers.

28. A method for making a candle unit having a top, comprising the steps of:

forming a supporting film for a candle, the supporting film being substantially self-supporting at ambient room temperature, forming a fuel core and positioning a wick in the liquid fuel core material, substantially surrounding the fuel core with the supporting film;

the fuel core having a melting temperature range, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein the steps of forming a supporting film for a candle, forming a fuel core and positioning a wick in the liquid fuel core material, and substantially surrounding the fuel core with the supporting film, further comprise the steps of:

forming the supporting film from at least one substantially nonflammable material;

forming the supporting film into a container shape, pouring liquid fuel core material into the container shape and positioning the wick in the liquid fuel core material; and permitting the liquid fuel core material to solidify, at least partially.

29. A method for making a candle unit having a top, comprising the steps of:

forming a supporting film for a candle, the supporting film being substantially self-supporting and formed from at least two layers, fabricated from different materials;

forming a fuel core and positioning a wick in the fuel core material, substantially surrounding the fuel core with the supporting film;

the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

30. The method according to claim 29, wherein each of the at least two layers of the supporting film are not readily soluble in molten fuel core material.

31. The method according to claim 29, wherein the step of forming a supporting film further comprises the step of forming the supporting film from a material from the group consisting of: cyclic olefin copolymers, polyhedral oligomeric silsesquioxanes.

32. The method according to claim 29, wherein at least one layer of the film is fabricated from a material selected from the group consisting of: cyclic olefin copolymers, polyhedral oligomeric silsesquioxanes.

33. The method according to claim 29, wherein at least one layer of the film is fabricated from a material selected from the group consisting of: polypropylene.

34. The method according to claim 29, wherein the film has one of the following characteristics: transparent, translucent, opaque.

35. The method according to claim 29, wherein the film includes at least one active ingredient from the group consisting of: fragrance materials, air freshener materials, insect repellent materials, flame retardant materials, dyes, pigments, plasticizers.

36. The method for making a candle unit according to claim 29, wherein each of the film and the fuel core has one of the following characteristics: transparent, translucent.

37. A method for forming a cased article, comprising the steps of:

forming a casing from a self-supporting film unit;

pouring a liquid gel material into the casing; wherein the self-supporting film structure is fabricated from one or more materials, each of which is insoluble in the liquid gel material.

38. The method according to claim 37, wherein the self-supporting film structure is fabricated from at least two layers.

39. The method according to claim 38, wherein one of the at least two layers is a material from the group consisting of: cyclic olefin copolymers, polyhedral oligomeric silsesquioxanes; and another of the at least two layers is fabricated from the group consisting of polypropylene.

40. A method for forming a cased article, comprising the steps of:

forming a casing from a self-supporting film structure; and pouring a liquid gel material into the casing; wherein the self-supporting film structure is fabricated from one or more materials, wherein the self-supporting film structure is fabricated from at least two layers.

41. The method according to claim 40, wherein one of the at least two layers is a material from the group consisting of: cyclic olefin copolymers; and another of the at least two layers is fabricated from the group consisting of polypropylene.

42. The method according to claim 40, wherein the self-supporting film structure is fabricated from one or more materials, each of which is not readily soluble in the liquid gel material.

43. A method for forming a cased article, comprising the steps of:

forming a gel structure having an exterior surface; and forming a substantially self-supporting film in one or more sheet portions;

wrapping one or more sheet portions of the substantially self-supporting film around at least portions of the gel structure;

joining adjoining edges of the one or more sheet portions, to form a casing surrounding at least a portion of the gel structure.

44. The method according to claim 43, wherein the self-supporting film structure is fabricated from at least two layers.

45. The method according to claim 43, wherein one of the at least two layers is a material from the group consisting of: cyclic olefin copolymers, polyhedral oligomeric silsesquioxanes; and another of the at least two layers is fabricated from the group consisting of polypropylene.

46. The method according to claim 43, wherein the self-supporting film structure is fabricated from one or more materials, each of which is substantially insoluble in the liquid gel material.

47. A candle unit having a top, comprising:

a fuel core, fabricated from a flammable fuel material, the fuel material having a fuel core melting temperature range;

a wick embedded in the fuel core, for drawing up molten fuel material, for supporting a candle flame;

a film, surrounding at least a portion of the fuel core, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein each of the film and the fuel core has one of the following characteristics: transparent, translucent.

48. The candle unit according to claim 47, wherein the film has a surface that has been contoured to form a Fresnel lens.

49. A candle unit having a top, comprising:

a fuel core, fabricated from a flammable fuel core material, the fuel core material having a fuel core melting temperature range;

a wick embedded in the fuel core, for drawing up molten fuel core material, for supporting a candle flame;

a film, surrounding at least a portion of the fuel core, the film being fabricated from at least two layers, fabricated from different materials, the at least two layers being fabricated from materials that have film softening temperature ranges, having upper-end temperatures that are greater than an upper-end melting temperature of the fuel core melting temperature range such that the fuel core material becomes liquid substantially sooner than the film becomes non-self-supporting due to softening, so that when the candle burns, a pool of fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein each of the film and the fuel core has one of the following characteristics: transparent, translucent.

50. A method for making a candle unit having a top, comprising the steps of:

forming a supporting film for a candle, the supporting film being substantially self-supporting at ambient room temperature, forming a fuel core and positioning a wick in the liquid fuel core material, substantially surrounding the fuel core with the supporting film;

the fuel core having a melting temperature range, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the aura of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained, wherein each of the film and the fuel core has one of the following characteristics: transparent, translucent.

51. A candle unit having a top, comprising:

a fuel core, fabricated from a flammable fuel material, the fuel material having a fuel core melting temperature range;

a wick embedded in the fuel core, for drawing up molten fuel material, for supporting a candle flame;

a film, surrounding at least a portion of the fuel core, the film being fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained;

wherein the fuel core material is a gelled oil, wherein the gelled oil is sold under the name Versagel™.

52. A candle unit having a top, comprising:

a fuel core, fabricated from a flammable fuel material, the fuel material having one of the following characteristics: clear, translucent, transparent; and having a first index of refraction;

a wick embedded in the fuel core, for drawing up molten fuel material, for supporting a candle flame;

a film, surrounding at least a portion of the fuel core, the film having one of the following characteristics: clear, translucent, transparent; and having at least a second index of refraction;

the fuel core and the film together forming a candle body;

the indices of refraction being operably configured so that upon lighting of the candle unit, at least a portion of the light radiated from the flame enters the fuel core and is reflected and/or refracted within the fuel core, prior to emanation as light emanating from the candle body.

53. The candle unit according to claim 52, wherein the fuel material has a fuel core melting temperature range; and the film is fabricated from at least one material, having a film softening temperature range, having an upper-end temperature that is greater than an upper-end temperature of the fuel core melting temperature range such that the fuel core material becomes liquid substantially sooner than the film becomes non-self-supporting due to softening, so that when the candle burns, a pool of molten fuel core fuel material forms on the top of the candle unit, around the candle flame, without immediately causing the film to become non-self-supporting, and a portion of the molten fuel core material is consumed, so that an upper surface of the pool is vertically spaced from a top edge of the film;

whereupon as the candle burns down, the top edge of the film is exposed to progressively higher temperature regions of the candle flame, and ultimately becomes non-self-supporting and recedes downward from the descending candle flame, while the pool of molten fuel core material is further consumed, so that a vertical spacing between the upper surface of the pool of molten fuel core material and the top edge of the film is maintained.

54. The candle unit according to claim 53, wherein the film is fabricated from at least one material that, when molten, is not readily soluble in the molten fuel core material.

55. The candle unit according to claim 53, wherein the film is fabricated from at least one layer of material selected from the group consisting of: cyclic olefin copolymers, polyhedral oligomeric silsesquioxanes.

56. The candle unit according to claim 55, wherein the film has a single layer.

57. The candle unit according to claim 55, wherein the film has at least two layers.

58. The candle unit according to claim 57, wherein the at least two layers are fabricated from different materials.

59. The candle unit according to claim 57, wherein at least one of the at least two layers is fabricated from at least one of the materials in the group consisting of: cyclic olefin copolymers, polyhedral oligomeric silsesquioxanes; and at least one of the at least two layers is fabricated from at least one of the materials in the group consisting of: polypropylene.

60. The candle unit according to claim 52, wherein the film has one of the following characteristics: transparent, translucent, opaque.

61. The candle unit according to claim 52, wherein the film includes at least one active ingredient from the group consisting of: fragrance materials, air freshener materials, insect repellent materials, flame retardant materials, dyes, pigments, plasticizers.

* * * * *